US007540493B2

(12) United States Patent
Konishi

(10) Patent No.: US 7,540,493 B2
(45) Date of Patent: Jun. 2, 2009

(54) IMAGE FORMING DEVICE

(75) Inventor: Takashi Konishi, Nagaokakyo (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 209 days.

(21) Appl. No.: 11/473,594

(22) Filed: Jun. 22, 2006

(65) Prior Publication Data

US 2007/0001370 A1 Jan. 4, 2007

(30) Foreign Application Priority Data

Jun. 30, 2005 (JP) ..... 2005-193153

(51) Int. Cl.
*B65H 1/26* (2006.01)

(52) U.S. Cl. ..... 271/157

(58) Field of Classification Search ..... 271/164, 271/157

See application file for complete search history.

(56) References Cited

U.S. PATENT DOCUMENTS 4,017,181 A * 4/1977 Komaba et al. ..... 355/72
4,280,692 A * 7/1981 Hutchinson et al. ..... 271/160
4,793,606 A * 12/1988 Yasuoka et al. ..... 271/157
5,004,217 A * 4/1991 Kano et al. ..... 271/10.11
5,181,713 A * 1/1993 Neugebauer ..... 271/160
5,232,214 A * 8/1993 Matsuura et al. ..... 271/127
5,292,116 A * 3/1994 Inoue et al. ..... 271/157
5,419,544 A * 5/1995 Ono et al. ..... 271/164
5,564,690 A * 10/1996 Oshida ..... 271/157
5,620,175 A * 4/1997 Hesoun ..... 271/34
5,741,008 A * 4/1998 Kiyohara ..... 271/127
6,231,042 B1 * 5/2001 Ito et al. ..... 271/157
6,659,444 B2 * 12/2003 Kawarama ..... 271/9.09
6,773,182 B2 * 8/2004 Yang ..... 400/624
2005/0230903 A1 * 10/2005 Lin ..... 271/118

FOREIGN PATENT DOCUMENTS

JP 08-290836 A 11/1996
JP 2000-062971 2/2000
JP 2000103527 A * 4/2000
JP 2001206563 A * 7/2001
JP 2001-225966 8/2001
JP 2001341854 A * 12/2001
JP 2002087602 A * 3/2002
JP 2002347954 A * 12/2002

* cited by examiner

*Primary Examiner*—Patrick H Mackey
*Assistant Examiner*—Howard Sanders
(74) *Attorney, Agent, or Firm*—Hogan & Hartson LLP

(57) ABSTRACT

In an image forming device, a paper feed cassette accommodating a plurality of papers is removably inserted in a cassette accommodating portion of a device main body. A locking member and a lock releasing member maintain a flapper at a prescribed pressed-down position. When the paper feed cassette is inserted into the cassette accommodating portion, after the flapper at the prescribed pressed-down position is unlocked, the flapper is temporarily caught at a position within a vertical swinging range of the flapper. After the paper feed cassette is completely inserted, the flapper is released.

20 Claims, 3 Drawing Sheets

IMAGE FORMING DEVICE

BACKGROUND OF THE INVENTION

1. Field of the Invention

The present invention relates to an image forming device such as a facsimile machine, a copier and a printer (including a Multi Function Peripheral (MFP) having a facsimile function, a copy function and a printer function). More particularly, the present invention relates to an image forming device in which a paper feed cassette for feeding printing papers to a printing unit is removably inserted in a cassette accommodating portion of a device main body.

2. Description of the Related Art

A paper feed cassette includes a flapper (a pressing-up plate) which is elastically urged upward by an elastic urging member, such as a compression spring, provided on a bottom surface of the paper feed cassette. Accordingly, under a state in which the paper feed cassette is inserted in a cassette accommodating portion of device main body, a leading edge of an uppermost sheet of printing papers accommodated and stacked in the paper feed cassette elastically makes contact with a paper feed roller or a separating claw. In order to facilitate supplying of the printing papers in the paper feed cassette, the paper feed cassette also includes a locking member for maintaining the flapper at a prescribed pressed-down position against an urging force of the elastic urging member. The cassette accommodating portion of the image forming device includes a lock releasing member which unlocks the locking member when the paper feed cassette is inserted into the cassette accommodating portion.

In the image forming device including the paper feed cassette and the cassette accommodating portion as described above, when the printing paper runs out in the paper feed cassette or when a remaining amount of the printing papers in the paper feed cassette becomes small, the paper feed cassette is normally filled full with printing papers. Therefore, an elevating width of the flapper when being unlocked at an insertion of the paper feed cassette becomes small for a stacked thickness of the printing papers. As a result, an impulse when the leading edge of the uppermost sheet of the stacked printing papers elastically makes contact with the paper feed roller or the separating claw becomes small. However, for example, sometimes it is necessary to temporarily fill in B5-sized printing papers instead of generally used A4-sized printing papers. In such a case, only a necessary number of B5-sized printing papers are filled in. That is, only a few sheets of printing papers are filled in. Therefore, when the flapper is unlocked at the insertion of the paper feed cassette, the flapper receives an elastic restoration force of the elastic urging member and instantly jumps for a long elevating width from the prescribed pressed-down position to a position where the leading edge of the uppermost sheet of the stacked printing papers makes contact with the paper feed roller or the separating claw.

As a result, a large impulse and a large impulsive sound generate. Consequently, peripheral mechanisms may be damaged, or the printing papers may be displaced. Alternatively, an operator may feel uncomfortable or insecure. In particular, in case of a paper feed cassette capable of accommodating a large number of printing papers, the urging force of the elastic urging member is set great and the elevating width also becomes long. As a result, the impulse and the impulsive sound become even larger. A first conventional art and a second conventional art disclose a paper feed cassette including a buffer member for buffering the impulse when the flapper elevates by being unlocked.

The paper feed cassette disclosed in the first conventional art includes a locking member, a lock releasing member, and a damper mechanism for controlling an elevating speed of a flapper (a pressing-up plate). Since a new mechanism is required to be installed, a structure of the paper feed cassette becomes complex and the costs of the paper feed cassette increase. The paper feed cassette disclosed in the second conventional art includes a regulation member. When a flapper (a pressing-up plate) elevates rapidly, the regulation member catches the flapper before the flapper hits a separating claw. Accordingly, it is possible to prevent a deformation of the separating claw and a generation of the impulsive sound. However, the regulation member is required to be newly installed. In addition, the elevating width of the flapper leading to the regulation member is long. As a result, there still remains a problem of the impulse and the impulsive sound of the regulation member and the flapper.

SUMMARY OF THE INVENTION

In order to overcome the problems described above, preferred embodiments of the present invention provide an image forming device having a simple structure which can buffer an impulse when a flapper is unlocked at an insertion of a paper feed cassette into a device main body of the image forming device.

According to a preferred aspect of the present invention, in an image forming device, a paper feed cassette capable of accommodating a plurality of printing papers is removably inserted in a cassette accommodating portion of a device main body of the image forming device. The paper feed cassette includes a flapper and a locking member. The flapper is urged upward by an elastic urging member and is capable of swinging vertically. When the flapper is pressed down against an urging force of the elastic urging member, the locking member maintains the flapper at a prescribed pressed-down position. The cassette accommodating portion includes a lock releasing member. The lock releasing member releases the locking member when the paper feed cassette is inserted. A temporary catching portion is formed on the locking member for temporarily catching the flapper when the paper feed cassette is inserted into the cassette accommodating portion.

While the paper feed cassette is being inserted into the cassette accommodating portion, the locking member and the lock releasing member release a locked state of the flapper at the prescribed pressed-down position. Then, the temporary catching portion temporarily catches the flapper at a position in a vertical swinging range of the flapper. When the paper feed cassette is completely inserted, the caught flapper is released. In this case, one temporary catching portion may be provided. However, the present invention is not limited to this example, and a plurality of catching portions may be provided. The temporary catching portion preferably catches the flapper when the locking member is making contact with the lock releasing member. The temporary catching portion preferably catches the flapper at a substantially intermediate position in the vertical swinging range of the flapper.

According to a preferred aspect of the present invention, the locking member includes an acting member and an elastic member. The acting member is mounted on a chassis of the paper feed cassette in a manner that the acting member can swing around a horizontal pin. The elastic member maintains the acting member at a standby position. The acting member includes an acting surface, a lock catching portion, and a temporary catching portion. When the flapper is pressed down, the flapper acts against an elastic force of the elastic member. Accordingly, the acting surface functions to swing the acting member around the horizontal pin. When the flapper is pressed down to a prescribed position, the lock catching portion maintains the flapper at the prescribed position by an elastic restoration force of the elastic member. The temporary catching portion temporarily catches the flapper which is elevating after being unlocked. The lock releasing member includes a mountain-shaped protrusion formed on an inner wall of the cassette accommodating portion. When inserting the paper feed cassette into the cassette accommodating portion, the protrusion makes contact with the acting member to swing the acting member against an elastic force of the elastic member in order to release the flapper caught by the lock catching portion. In addition, the protrusion functions to catch the released flapper by the temporary catching portion. Accompanying a subsequent insertion movement of the paper feed cassette, the protrusion also releases the temporary catching portion.

According to the above-described image forming device, after the locked state of the flapper at the prescribed pressed-down position is released, the flapper is temporarily caught at a position in the vertical swinging range. Therefore, even when a small number of printing papers are filled in the paper feed cassette and the paper feed cassette is inserted into the cassette accommodating portion, after the flapper is unlocked, the flapper is caught once at a position in the vertical swinging range. Then, the leading edge of the printing papers stacked on the flapper makes contact with the paper feed roller, the separating claw or the like. As a result, the impulse when the printing papers make contact with the paper feed roller, the separating claw or the like is considerably buffered. Such a function for buffering the impulse is accomplished by a structural relation of the locking member and the lock releasing member. Therefore, a new impulse buffering mechanism other than the locking member and the lock releasing member is not required to be provided. The function for buffering the impulse can be accomplished without increasing a number of components and without increasing the costs. In particular, if the locking member and the lock releasing member are configured as described above, the structure is simple and efficient.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

With reference to the drawings, preferred embodiments of the present invention will be described.

Figure 1:
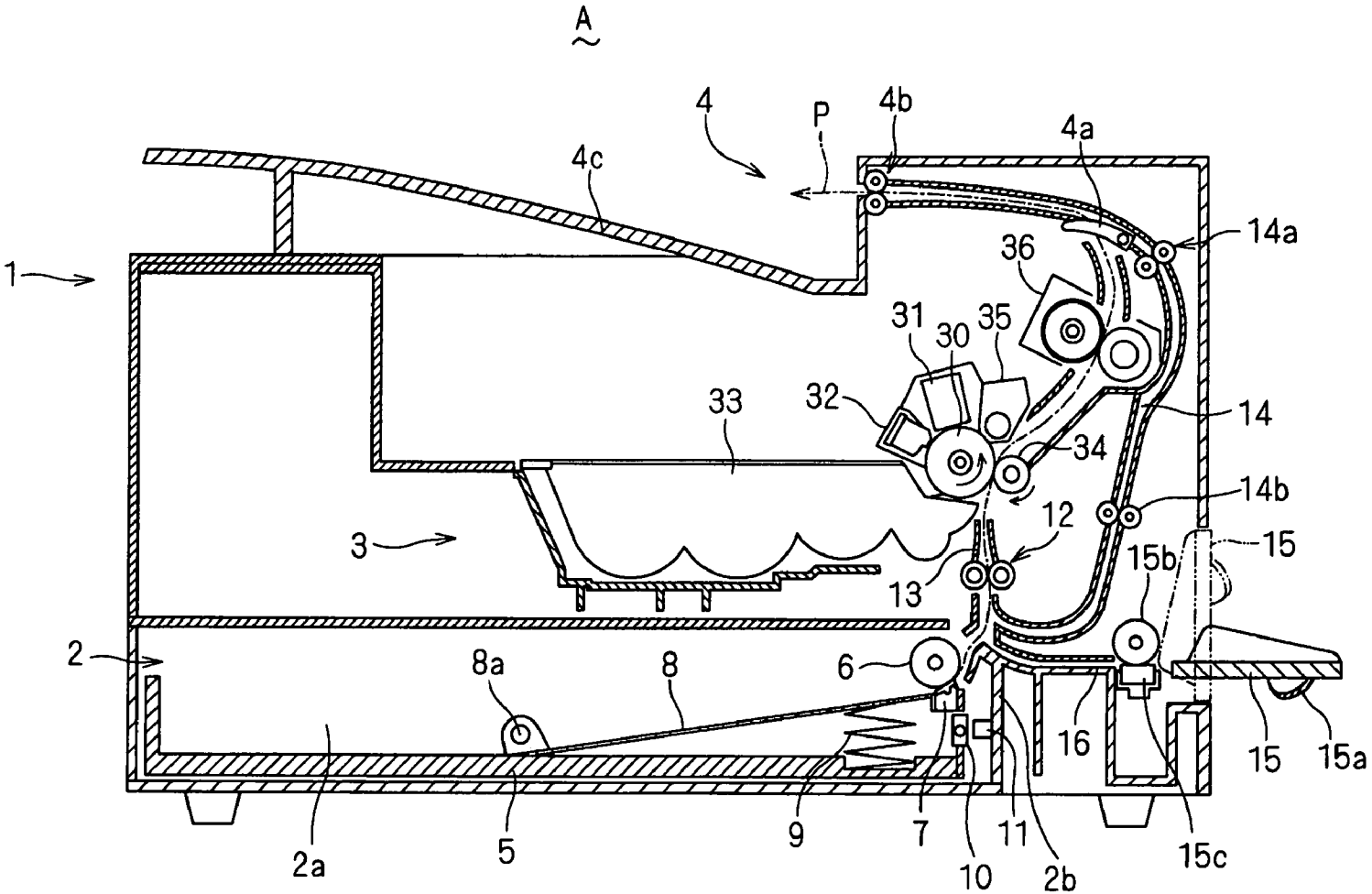
FIG. 1 is a lateral cross-sectional view illustrating an example of an image forming device according to a preferred embodiment of the present invention.

An image forming device (A) illustrated in FIG. 1 is a printer including an electrophotographic printing unit. The image forming device (A) is not limited to such an example. For example, the image forming device (A) may be a copier including an image scanner unit, a facsimile machine, or an MFP including a copy function and a facsimile function. In FIG. 1, a device main body 1 of the image forming device (A) includes a paper feed unit 2 accommodating printing papers, an electrophotographic printing unit 3, and an output unit 4 where printed papers are output. The paper feed unit 2, the printing unit 3 and the output unit 4 are vertically stacked in this order.

The paper feed unit 2 includes a cassette accommodating portion 2*a*. A paper feed cassette 5 is removably inserted in the cassette accommodating portion 2*a* in a direction perpendicular to the vertical direction of the page of FIG. 1. The paper feed cassette 5 accommodates a plurality of printing papers. The paper feed cassette 5 includes a separating and feeding roller 6, a separating pad 7, a flapper 8, a compression coil spring (elastic urging member) 9, and a locking member 10. The separating and feeding roller 6 is arranged at a front end portion (paper feeding side) of the paper feed cassette 5. The separating pad 7 elastically makes contact with the surface of the separating and feeding roller 6. The flapper 8 is mounted on a bottom surface of the paper feed cassette 5 via a hinge pin 8*a* such that the flapper 8 can be swung vertically. The compression coil spring 9 urges a swinging end side of the flapper 8 in an upward direction. The locking member 10 maintains the flapper 8 at a prescribed pressed-down position. Although not illustrated in the drawings, the paper feed cassette 5 includes an adjustable trailing edge restricting member or an adjustable side restricting member or the like in the same manner as a known paper feed cassette. A lock releasing member 11 is formed on an inner wall 2*b* of the front end side (a paper feeding side) of the cassette accommodating portion 2*a* at a position corresponding to the locking member 10. The locking member 10 and the lock releasing member 11 will be described later.

The image printing unit 3 includes a process portion and a fixing unit 36 provided downstream of the process portion. In the process portion, a charging unit 31, an exposing unit 32 including a Light Emitting Diode (LED), a developing unit 33, a transfer roller 34 and a foreign substance removing cleaner 35 are arranged in this order around a photoconductive drum 30. The photoconductive drum 30, the charging unit 31, the developing unit 33, and the foreign substance removing cleaner 35 are unitized as a process unit. A drum unit and a developing unit may be provided separately. The drum unit and the developing unit may be individually inserted and removed with respect to the device main body 1. The process unit is removably inserted in the perpendicular direction with respect to the vertical direction of the page of FIG. 1. Alternatively, the process unit may be taken out from an upper portion of the device main body 1. Further, the image printing unit 3 is not limited to the electrophotographic method. For example, the image printing unit 3 may adopt a known printing method (including color) such as an inkjet method and a bubble jet (registered trademark) method.

The output unit 4 includes a switching gate 4*a*, an output roller pair 4*b* and an output tray 4*c*, which are arranged downstream of the fixing unit 36. A resist roller pair 12 is arranged near upstream of the process portion. The printing papers are separated and fed from the paper feed cassette 5 one sheet at a time by the separating and feeding roller 6 and the separating pad 7. Then, the printing paper is resisted by the resist roller pair 12 and is guided into a contact portion between the photoconductive drum 30 and the transfer roller 34. The photoconductive drum 30 rotates in a direction indicated by an arrow in FIG. 1, and a surface of the photoconductive drum 30 is uniformly charged by the charging unit 31.

An optical image based on image information is irradiated on the surface of the photoconductive drum 30 by the exposing unit 31. Accordingly, an electrostatic latent image is formed on the surface of the photoconductive drum 30. The electrostatic latent image is sequentially developed by the developing unit 33, and is lead to the contact portion between the photoconductive drum 30 and the transfer roller 34 as a toner image. The resist roller pair 12 is controlled to be driven and rotated such that the printing paper is guided into the contact portion in synchronism with the toner image formed on the surface of the photoconductive drum 30.

Bias is applied to the transfer roller 34. The transfer roller 34 nips and transports the printing paper with the photoconductive drum 30 while being driven and rotated in a direction indicated by an arrow (in a width direction with respect to the photoconductive drum 30). During this period, the toner image on the surface of the photoconductive drum 30 is transferred onto the printing paper. After the toner image is transferred onto the printing paper, the printing paper is guided to the fixing unit 36. The fixing unit 36 fixes the toner image as a permanent image. Then, the printing paper pushes up the switching gate 4*a* and is output onto the output tray 4*c* via the output roller pair 4*b*. The series of the transportation of the printing paper involves a main paper transportation path 13 and is carried out along a feeding path P (illustrated by dashed lines in FIG. 1). Further, the main paper transportation path 13 rises substantially perpendicularly (vertically) from the paper feed cassette 5. The feeding path P makes a U-turn such that at the output roller pair 4*b*, the feeding path P faces approximately 180 degrees in an opposite direction from a direction in which the printing paper is fed from the paper feed cassette 5.

The image forming device (A) illustrated in FIG. 1 includes a duplex printing function. A reversal paper transportation path 14 is formed from a mounted position of the switching gate 4*a* on the feeding path P and joins the main paper transportation path 13 upstream of the resist roller pair 12. The output roller pair 4*b* is rotatable in both directions. Transportation roller pairs 14*a* and 14*b* are arranged along the reversal paper transportation path 14. When carrying out a duplex printing operation, after a printing operation is performed on a first side of the printing paper as described above, the printing paper is transported along the feeding path P. When a trailing edge of the printing paper reaches the output roller pair 4*b*, the output roller pair 4*b* stops once and nips the trailing edge of the printing paper. Next, the output roller pair 4*b* rotates backward. The printing paper is transported through the reversal paper transportation path 14 from its trailing edge by the transportation roller pairs 14*a* and 14*b*. The printing paper enters the main paper transportation path 13 and is led to the resist roller pair 12. The printing paper is resisted by the resist roller pair 12 and is guided again into the contact portion between the photoconductive drum 30 and the transfer roller 34. Then, a printing operation is performed on a second side of the printing paper. After the duplex printing operation is performed, the printing paper is transported along the feeding path P and is output onto the output tray 4*c*.

The image forming device (A) also includes a manual feeding function. A manual feeding tray 15 is arranged on a side of the device main body 1. The manual feeding tray 15 can be opened and closed. When the manual feeding tray 15 is not used, the manual feeding tray 15 is closed as illustrated with double dashed lines in FIG. 1. The manual feeding tray 15 can be opened and closed by a gripper 15*a*. A separating and feeding roller 15*b* and a separating pad 15*c* are arranged downstream of the manual feeding tray 15 in a paper feeding direction. The separating and feeding roller 15*b* and the separating pad 15*c* elastically contact one another. A manual paper feeding path 16 is arranged downstream of the separating and feeding roller 15*b* and the separating pad 15*c*, and joins the main paper transportation path 13.

When carrying out an image printing operation by the manual feeding tray 15, the manual paper feeding tray 15 is opened by the gripper 15*a*. A printing paper is set on the manual feeding tray 15. By carrying out a starting operation, the manual paper feeding roller 15*b* is operated. The printing paper on the manual feeding tray 15 is separated and fed one sheet at a time by an operation of the separating and feeding roller 15*b* and the separating pad 15*c*. The printing paper is transported through the manual paper transportation path 16 and joins the main paper transportation path 13. Then, the printing paper is resisted by the resist roller pair 12 and is guided into the contact portion between the photoconductive drum 30 and the transfer roller 34. Then, a printing operation is performed. When carrying out a duplex printing operation on the manually fed printing paper, the output roller pair 4*b* rotates backward to transport the printing paper through the reversal paper transportation path 14. The printing operation is performed on the second side of the printing paper as described above. After the printing operation has been completed, the printing paper is output onto the output tray 4*c* by the output roller pair 4*b*.

Next, with reference to FIG. 2 and FIG. 3, the locking member 10 and the lock releasing member 11 of the flapper 8 will be described in more detail. An opening 5*b* is formed on a front wall portion 5*a* of a chassis of the paper feed cassette 5. The locking member 10 is arranged in the opening 5*b*. A horizontal pin 5*c* is fixed in the opening 5*b*. An acting member 17 is mounted on the horizontal pin 5*c* such that the acting member 17 can be swung around the horizontal pin 5*c*. A torsion spring (elastic member) 18 is fit on the horizontal pin 5*c*. Both ends of the torsion spring 18 are caught by the front wall portion 5*a* and the acting member 17, respectively. The acting member 17 and the torsion spring 18 form the locking member 10. The acting member 17 is urged at all times in a direction of an arrow X in FIG. 2A by an elastic force of the torsion spring 18. Two vertical guide ribs 5*d* are formed on an inner surface of the front wall portion 5*a*. When filling the printing papers in the paper feed cassette 5, the leading edge of the printing papers is aligned along the guide ribs 5*d*.

A stopper portion 17*a* is formed on a lower outer potion of the acting member 17. Under a state in which an outer force other than the elastic force of the torsion spring 18 is not acting upon the acting member 17, the stopper portion 17*a* makes contact with a lower side of the opening 5*b* by the elastic force. Accordingly, the acting member 17 is prevented from swinging and is maintained under a standing condition (standby position) as illustrated in FIG. 2A and FIG. 2C. An acting surface 17*b* is formed on an inner lower-half portion of the acting member 17 and protrudes inward with respect to the paper feed cassette 5. A lock catching portion 17*c* is formed on a lower corner of the acting surface 17*b*. A temporary catching portion 17*d* is formed on and protrudes inward from an upper end of the acting member 17. The acting surface 17*b* and the lock catching portion 17*c* are located at one side with respect to a shaft center of the horizontal pin 5*c*. The temporary catching portion 17*d* is located at another side with respect to the shaft center of the horizontal pin 5*c*. A protruding portion 17*e* is formed on a rear side of the temporary catching portion 17*d*. The protruding portion 17*e* is a cam follower for receiving an action of a protrusion 11 described hereinafter. A catching overhang portion 8*b* extends from a position on a front end portion of the flapper 8 corresponding to the acting member 17. The catching overhang portion 8*b* can catch the lock catching portion 17*c* and the temporary catching portion 17*d*.

The protrusion (lock releasing member) 11 is a mountain-shaped cam in its plan view and is fixed on the inner wall 2*b* of the front end side of the cassette accommodating portion 2*a*. Protrusion 11 is fixed at a position where it interferes with the protruding portion 17*e* when the paper feed cassette 5 is inserted into the cassette accommodating portion 2*a*. In addition, the fixed position of the protrusion 11 is set such that the protrusion 11 is located at an insertion side than the protruding portion 17*e* when the paper feed cassette 5 is inserted and set in a proper accommodated position (refer to FIG. 3C).

Next, the operation of the locking member 10 and the lock releasing member 11 when the paper feed cassette 5 is inserted into the cassette accommodating portion 2*a* will be described. FIG. 2A and FIG. 3A illustrate a state at an initial stage when the paper feed cassette 5 accommodating a small number of printing papers S is inserted into the cassette accommodating portion 2*a*. An operator pulls out the paper feed cassette 5 from the cassette accommodating portion 2*a*. The operator places the printing papers S on the flapper 8 in a manner that the leading edge of the printing papers S is positioned along the guide ribs 5*d*. The trailing edge or a side edge of the printing papers S is positioned by the trailing edge restricting member or the side restricting member (not illustrated) The front end portion of the flapper 8 and the printing papers S are pressed down against. the elastic force of the compression coil spring 9. By the pressing movement, the front end portion of the flapper 8 swings downward around the hinge pin 8*a*. The catching overhang portion 8*b* acts on the acting surface 17*b* of the acting member 17.

Figure 2A:
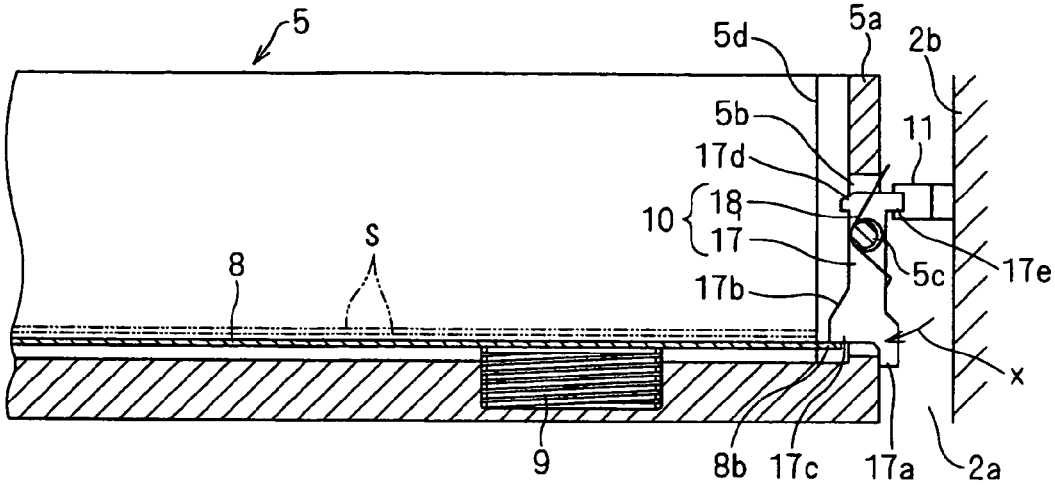
FIG. 2A through FIG. 2C are partial enlarged lateral cross-sectional views illustrating an operation state of the image forming device according to a preferred embodiment of the present invention.
Figure 3A:
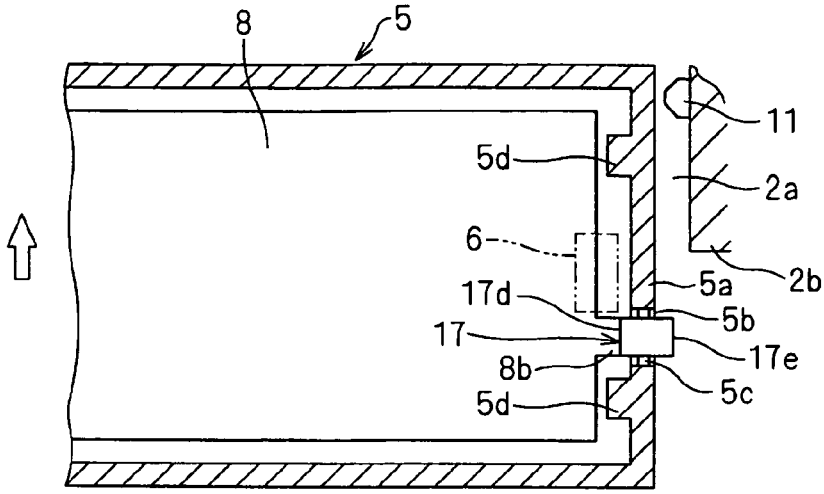
FIG. 3A through FIG. 3C are partial enlarged plan views illustrating an operation state of the image forming device according to a preferred embodiment of the present invention.

The acting member 17 swings around the horizontal pin 5*c* in a direction opposite to a direction X in FIG. 2A against the elastic force of the torsion spring 18 by an acting force applied to the acting surface 17*b*. When the flapper 8 is pressed down further and the catching overhang portion 8*b* passes the lower end of the acting surface 17*b*, the acting force is released and the acting member 17 swings in the direction X by an elastic restoration force of the torsion spring 18. The acting member 17 returns to an original standby position. When the acting member 17 returns to the standby position as described above, the catching overhang portion 8*b* slips into a lower side of the lock catching portion 17*c*. In addition, an upward urging force of the compression coil spring 9 with respect to the catching overhang portion 8*b* is balanced with the urging force of the torsion spring 18 in the direction X, and the slipped-in state is stably maintained. Therefore, even when the operator releases the hand, as illustrated in FIG. 2A, the flapper 8 is locked and maintained at a prescribed pressed-down position.

Figure 2B:
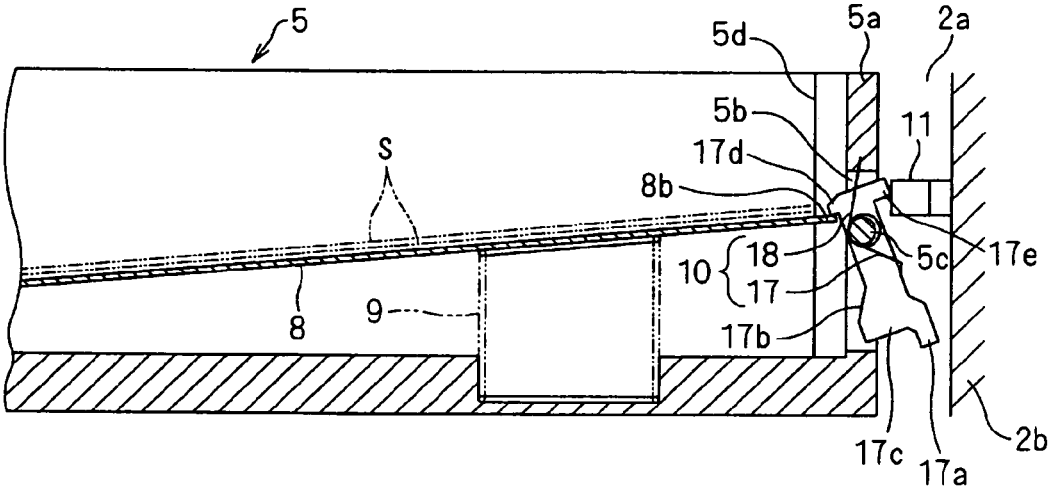
Figure 2C:
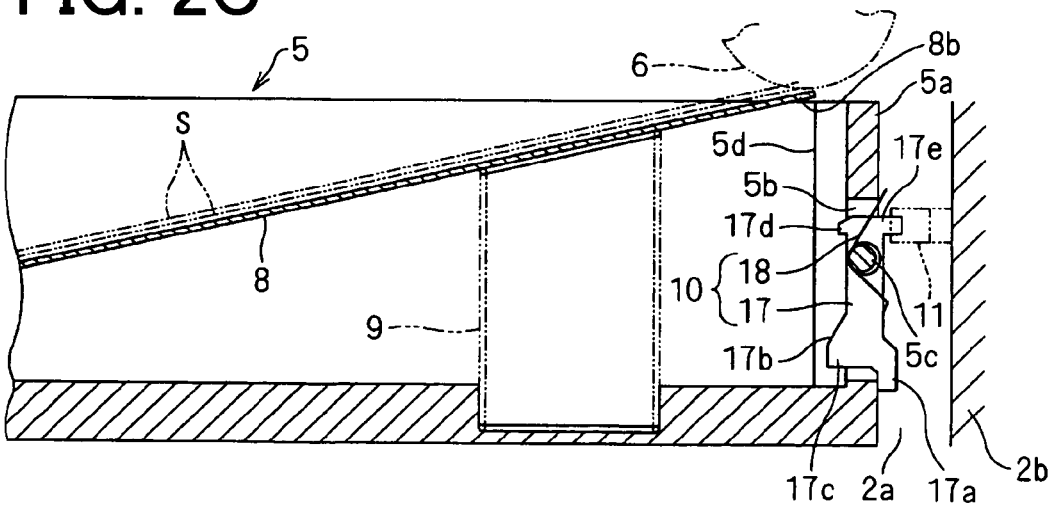
Figure 3B:
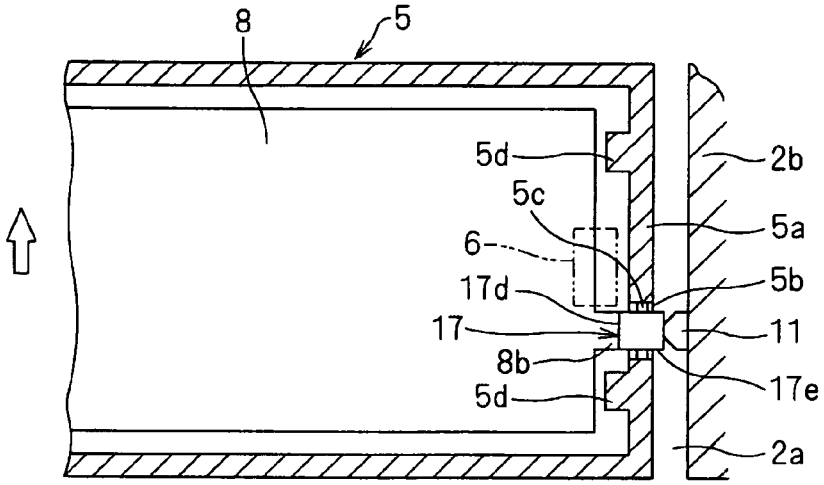

When the paper feed cassette 5 accommodating the printing papers S as described above is inserted into the cassette accommodating portion 2*a* along a direction indicated by an outlined arrow in FIG. 3A and FIG. 3B, the protruding portion 17*e* of the acting member 17 makes contact with the protrusion 11. When the paper feed cassette 5 continues to be inserted, the acting member 17 swings in the direction opposite to the direction X illustrated in FIG. 2B against the elastic force of the torsion spring 18 by a cam action of the protrusion 11 with respect to the protruding portion 17*e*. By the swinging movement, the locked state of the catching overhang portion 8*b* by the lock catching portion 17*c* is released, and the flapper 8 swings upward by receiving the urging force of the compression coil spring 9. In this case, by the swinging movement of the acting member 17 in the direction opposite to the direction X, the temporary catching portion 17*d* moves into an upward swinging track of a tip end portion of the catching overhang portion 8*b*. Accordingly, the tip end portion of the catching overhang portion 8*b* is caught by the temporary catching portion 17*d*. The caught state is maintained while the protruding portion 17*e* slides over a top surface of the protrusion 11. While the flapper 8 is elevating, the flapper 8 is maintained under a temporarily caught state as illustrated in FIG. 2B.

Figure 3C:
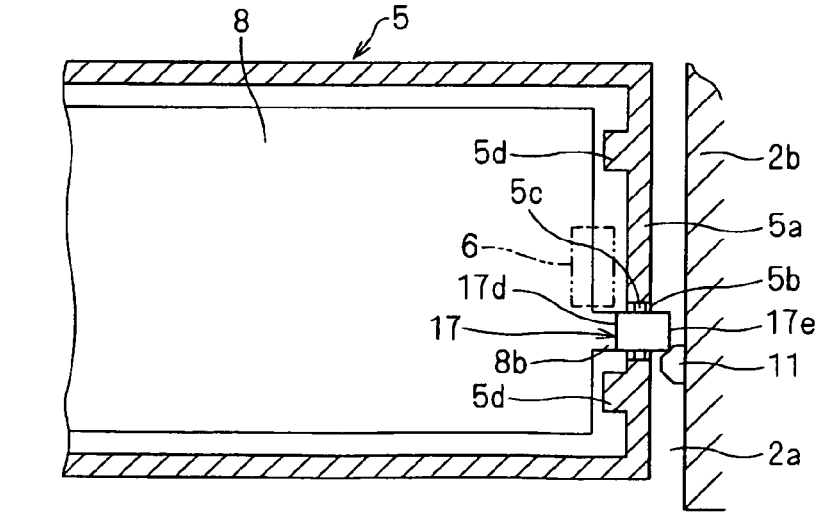

When the paper feed cassette 5 is inserted further, as illustrated in FIG. 3C, the protruding portion 17*e* is displaced and released from the protrusion 11. Then, the paper feed cassette 5 is set at a proper accommodated position. As a result, the acting member 17 swings in the direction X by the elastic restoration force of the torsion spring 18. Accompanying the swinging movement, the catching overhang portion 8*b* is released from the temporary catching portion 17*d*, and the flapper 8 swings upward by the urging force of the compression coil spring 9. As illustrated in FIG. 2C, the front end side of the flapper 8 and the printing papers S elastically make contact with the surface of the separating and feeding roller 6. Under this state, when the separating and feeding roller 6 and each mechanism and the process portion located downstream of the separating and feeding roller 6 are operated, a predetermined image is sequentially printed onto the printing papers S separated and fed one sheet at a time from the paper feed cassette 5. Then, the printing papers S are output onto the output unit 4*c*. When the paper feed cassette 5 is inserted to a proper inserted position, the protrusion 11 makes contact with the protruding portion 17*e* at a position illustrated in FIG. 3C. Accordingly, the paper feed cassette 5 is positioned. When removing the paper feed cassette 5 from the device main body 1, the protrusion 11 and the acting member 17 operate in a relation opposite from the relation described above. Since the flapper 8 is located at the position as illustrated in FIG. 2C, the flapper 8 is maintained at the position regardless of the operation of the protrusion 11 and the acting member 17.

As described above, when inserting the paper feed cassette 5 accommodating a few sheets of printing papers S into the cassette accommodating portion 2*a*, the flapper 8 released by the lock releasing member 11 elevates (swings upward) by the urging force of the compression coil spring 9. During this movement, the catching overhang portion 8*b* is temporarily caught by the temporary catching portion 17*d*. Then, the flapper 8 elevates again to elastically make contact with the surface of the separating and feeding roller 6. Therefore, when the flapper 8 makes contact with the separating and feeding roller 6, the impulse is small. As a result, the impulsive sound is also small. In addition, the printing papers S are not displaced, and the peripheral mechanisms are not damaged. Since such a function is accomplished by a simple structural coupled relation of the locking member 10 and the lock releasing member 11, the function can be accomplished easily without requiring an increase in the costs.

When inserting the paper feed cassette 5 accommodating a large number of printing papers into the cassette accommodating portion 2*a*, before the protruding portion 17*e* interferes with the protrusion 11, the leading edge of the uppermost sheet of the stacked printing papers elastically makes contact with the surface of the separating and feeding roller 6, and the flapper 8 stops under such a state. As a result, since the elevating width of the flapper 8 is small and a large number of printing papers are stacked on the flapper 8, the impulse does not become large when the stacked printing papers make contact with the separating and feeding roller 6. While the paper feed cassette 5 accommodating a large number of printing papers is being inserted into the proper position in the cassette accommodating portion 2*a*, the protruding portion 17*e* interferes with the protrusion 11. Accordingly, the acting member 17 swings in the direction opposite from the direction X and in the direction X in the same manner as described above. However, since the catching overhang portion 8*b* is maintained at a lower position, the flapper 8 is not caught by the temporary catching portion 17*d*.

Although the separating and feeding roller 6 and the separating pad 7 are partially not illustrated in FIG. 2A through FIG. 3C, the separating and feeding roller 6 and the separating pad 7 are set at a prescribed position as illustrated in FIG. 1. The above-described preferred embodiment refers to an example of the paper feed cassette adopting a separating pad. The present invention is also applicable to a paper feed cassette including a separating claw or a paper feed cassette including both the separating pad and the separating claw. The above-described preferred embodiment refers to an example in which the image forming device (A) is a printer including a single cassette. The present invention is also applicable to a printer including multiple cassettes. Alternatively, an option cassette or the like may be stacked below the paper feed cassette 5 in FIG. 1.

While the present invention has been described with respect to preferred embodiments thereof, it will be apparent to those skilled in the art that the disclosed invention may be modified in numerous ways and may assume many embodiments other than those specifically set out and described above. Accordingly, the appended claims are intended to cover all modifications of the present invention that fall within the true spirit and scope of the present invention.

What is claimed is:

1. An image forming device comprising:

a paper feed cassette which accommodates a plurality of papers;

a cassette accommodating portion which removably accommodates the paper feed cassette;

a flapper which is arranged in the paper feed cassette and swings vertically;

an elastic urging member which is arranged in the paper feed cassette and urges the flapper upward;

means for locking the flapper at a prescribed pressed-down first position when the flapper is pressed down against an urging force of the elastic urging member;

means for releasing the means for locking when the paper feed cassette is inserted in the cassette accommodating portion; and a temporary catching portion which is formed on the means for locking and stops the flapper at a second position elevated higher than the first position when inserting the paper feed cassette into the cassette accommodating portion, wherein the temporary catching portion does not contact the flapper at the first position and contacts the flapper at the second position.

2. The image forming device according to claim 1, wherein the means for locking and the means for releasing are configured such that when the paper feed cassette is inserted into the cassette accommodating portion, a locked state of the flapper at the prescribed pressed-down position is released and the temporary catching portion temporarily catches the flapper within a vertical swinging range of the flapper, and when the paper feed cassette is completely inserted in the cassette accommodating portion, the flapper is released.

3. The image forming device according to claim 2, wherein the temporary catching portion temporarily catches the flapper when the means for locking is in contact with the means for releasing.

4. The image forming device according to claim 3, wherein the temporary catching portion temporarily catches the flapper at a substantially intermediate position within the vertical swinging range of the flapper.

5. The image forming device according to claim 1, wherein the means for locking includes:

an acting member which is mounted on a chassis of the paper feed cassette in a manner capable of being swung around a horizontal pin, and an elastic member which maintains the acting member at a standby position.

6. The image forming device according to claim 5, wherein the acting member includes an acting surface which functions to swing the acting member around the horizontal pin by the flapper acting against an elastic force of the elastic member when the flapper is pressed downward.

7. The image forming device according to claim 6, wherein the acting member includes a lock catching portion which maintains the flapper at the prescribed pressed-down position by an elastic restoration force of the elastic member when the flapper is pressed down to the prescribed pressed-down position.

8. The image forming device according to claim 7, wherein the acting member further includes the temporary catching portion which temporarily catches the flapper that is elevated after being unlocked.

9. The image forming device according to claim 8, wherein the means for releasing includes a protrusion formed on an inner wall of the cassette accommodating portion.

10. The image forming device according to claim 9, wherein when inserting the paper feed cassette into the cassette accommodating portion, the protrusion makes contact with the acting member and swings the acting member so as to release the locked state of the lock catching portion against an elastic force of the elastic member, the protrusion also catches the released flapper by the temporary catching portion, and accompanying a subsequent insertion movement, the protrusion releases the flapper caught by the temporary catching portion.

11. The image forming device according to claim 10, wherein the acting member includes a protruding side which makes contact with the protrusion when the paper feed cassette is inserted into the cassette accommodating portion.

12. The image forming device according to claim 11, wherein when the paper feed cassette is inserted in the cassette accommodating portion, the protrusion is located at an outer side than the protruding side.

13. An image forming device comprising:

a paper feed cassette which accommodates a plurality of papers;

a cassette accommodating portion which removably accommodates the paper feed cassette;

a flapper which is arranged in the paper feed cassette and swings vertically;

an elastic urging member which is arranged in the paper feed cassette and urges the flapper upward;

a guide rib which is arranged on an inner surface of a front wall portion of the paper feed cassette;

means for locking the flapper at a prescribed pressed-down first position when the flapper is pressed down against an urging force of the elastic urging member;

means for releasing the means for locking when the paper feed cassette is inserted in the cassette accommodating portion; and a temporary catching portion which is formed on the means for locking and stopping the flapper at a second position elevated higher than the first position when inserting the paper feed cassette into the cassette accommodating portion, wherein the temporary catching portion does not contact the flapper at the first position and contacts the flapper at the second position.

14. The image forming device according to claim 13, comprising a plurality of guide ribs.

15. The image forming device according to claim 14, wherein the means for locking includes:

an acting member which is mounted on a chassis of the paper feed cassette in a manner capable of being swung around a horizontal pin, and an elastic member which maintains the acting member at a standby position.

16. The image forming device according to claim 15, wherein the elastic member is a torsion spring.

17. The image forming device according to claim 16, wherein the acting member includes an acting surface which functions to swing the acting member around the horizontal pin by the flapper acting against an elastic force of the elastic member when the flapper is pressed down.

18. The image forming device according to claim 17, wherein the acting member further includes a lock catching portion which maintains the flapper at a pressed-down position by an elastic restoration force of the elastic member when the flapper is pressed down to the prescribed position.

19. The image forming device according to claim 18, wherein the acting member further includes the temporary catching portion which temporarily catches the flapper that is elevating after being unlocked.

20. The image forming device according to claim 19, wherein the means for releasing includes a protrusion arranged on an inner wall of the cassette accommodating portion, and when inserting the paper feed cassette into the cassette accommodating portion, the protrusion makes contact with the acting member and swings the acting member so as to release the locked state of the lock catching portion against an elastic force elastic member, the protrusion also catches the released flapper by the temporary catching portion, and accompanying a subsequent insertion movement, the protrusion releases the flapper caught by the temporary catching portion.

* * * * *